US011814589B2

(12) United States Patent
Kim et al.

(10) Patent No.: US 11,814,589 B2
(45) Date of Patent: Nov. 14, 2023

(54) SOLVENT COMPOSITION PREPARED FROM WASTE OIL AND METHOD OF PREPARING THE SAME

(71) Applicants: SK Innovation Co., Ltd., Seoul (KR); SK Geo Centric Co., Ltd., Seoul (KR)

(72) Inventors: Do Kyoung Kim, Daejeon (KR); Ka Young Kim, Daejeon (KR); Jeong Eop Choi, Daejeon (KR); Ok Youn Kim, Daejeon (KR); Hee Soo Kim, Daejeon (KR); Young Moo Park, Daejeon (KR); Ho Won Lee, Daejeon (KR); Jae Suk Choi, Daejeon (KR); Hee Jung Jeon, Daejeon (KR)

(73) Assignees: SK Innovation Co., Ltd., Seoul (KR); SK Geo Centric Co., Ltd., Seoul (KR)

( * ) Notice: Subject to any disclaimer, the term of this patent is extended or adjusted under 35 U.S.C. 154(b) by 0 days.

(21) Appl. No.: 17/724,889

(22) Filed: Apr. 20, 2022

(65) Prior Publication Data

US 2022/0340824 A1 Oct. 27, 2022

(30) Foreign Application Priority Data

Apr. 21, 2021 (KR) ..... 10-2021-0051878

(51) Int. Cl.
*C10G 45/04* (2006.01)
*C10G 45/34* (2006.01)

(52) U.S. Cl.
CPC ..... *C10G 45/04* (2013.01); *C10G 45/34* (2013.01); *C10G 2300/1007* (2013.01); *C10G 2300/202* (2013.01); *C10G 2300/205* (2013.01); *C10G 2300/301* (2013.01)

(58) Field of Classification Search
CPC ..... C10G 45/04; C10G 45/34; C10G 2300/1007; C10G 2300/202; C10G 2300/205; C10G 2300/301; C10G 67/06; C10G 67/08; C10G 67/14; C10G 2300/1003; C10G 2400/18; C10G 1/002;
(Continued)

(56) References Cited

U.S. PATENT DOCUMENTS

| | | | |
|---|---|---|---|
| 2016/0264874 | A1 | 9/2016 | Narayanaswamy et al. |
| 2019/0177626 | A1 | 6/2019 | Ramamurthy et al. |
| 2022/0235276 | A1 | 7/2022 | Paasikallio et al. |

FOREIGN PATENT DOCUMENTS

| | | | |
|---|---|---|---|
| GB | 1017000 | A | 1/1966 |
| JP | H6228568 | A | 8/1994 |
| JP | 2019534926 | A | 12/2019 |

(Continued)

*Primary Examiner* — Randy Boyer
*Assistant Examiner* — Juan C Valencia
(74) *Attorney, Agent, or Firm* — THE WEBB LAW FIRM

(57) ABSTRACT

Provided is a technology to convert an oil having a high content of Cl into a solvent. Impurities such as Cl, S, N, and metals are removed from an oil having a boiling point of 340° C. or lower in a waste oil having a high content of Cl, and hydrogenation is carried out to recover an oil, and the oil may be applied as a solvent. Separation by boiling points to meet the properties of the solvent product is performed, a solid acid material and an oil having a high Cl content are mixed, impurities are removed by a heat treatment at a high temperature, and hydrogenation is carried out with a metal oxide catalyst, thereby manufacturing a solvent product.

9 Claims, 6 Drawing Sheets

(58) Field of Classification Search
CPC ..... C10G 7/003; C10G 7/006; C10G 17/095;
C10G 45/60
See application file for complete search history.

(56) References Cited

FOREIGN PATENT DOCUMENTS

WO 2020239729 A1 12/2020
WO WO-2021204821 A1 * 10/2021

* cited by examiner

【FIG. 1】
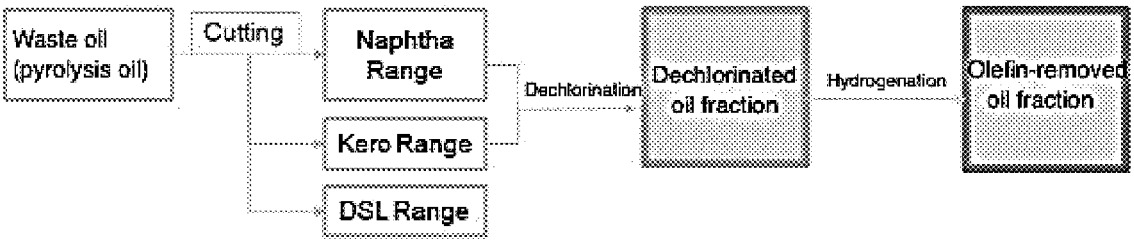

【FIG. 2】
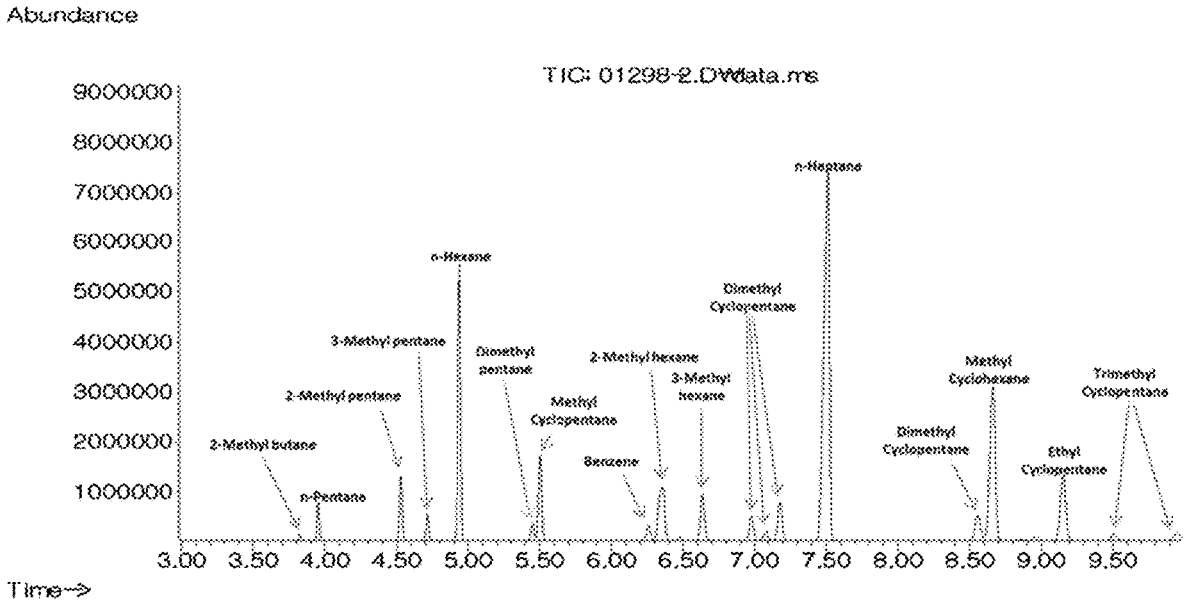

【FIG. 3】
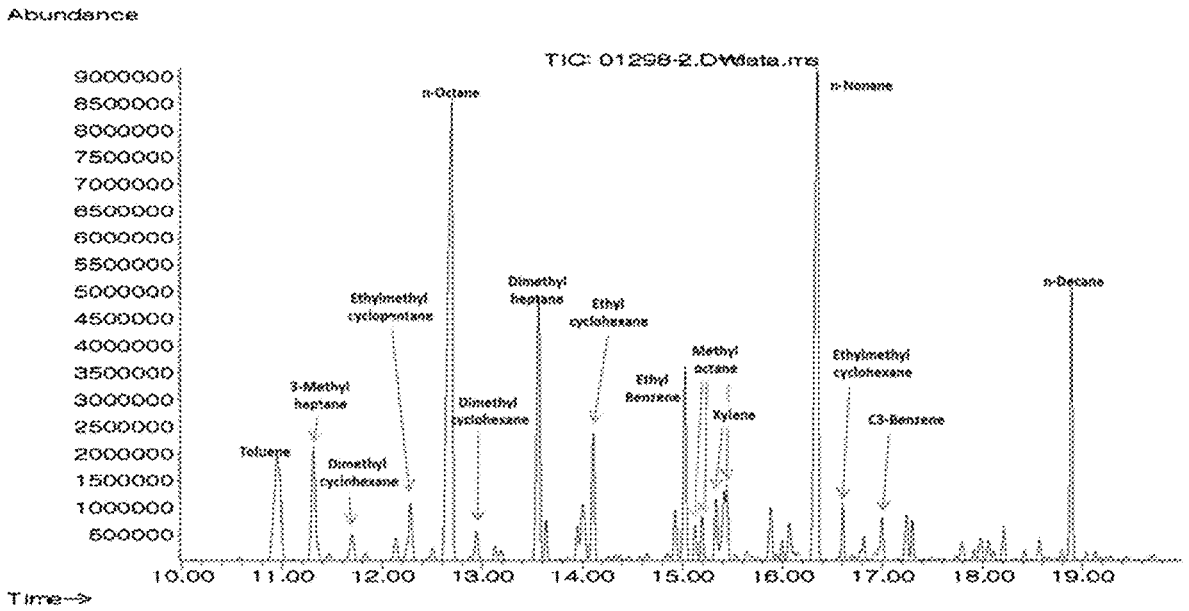

【FIG. 4】
| Component | Content, area% |
|---|---|
| IC5 | 0.07 |
| NC5 | 0.49 |
| IC6 | 1.20 |
| NC6 | 4.70 |
| CyC6 | 2.16 |
| AC6 | 0.27 |
| IC7 | 2.14 |
| NC7 | 12.02 |
| CyC7 | 7.10 |
| AC7 | 1.78 |
| IC8 | 5.58 |
| NC8 | 16.45 |
| CyC8 | 4.45 |
| AC8 | 3.55 |
| IC9 | 10.97 |
| NC9 | 13.15 |
| CyC9 | 6.86 |
| AC9 | 0.77 |
| IC10 | 1.47 |
| NC10 | 3.70 |
| CyC10 | 0.84 |
| AC10 | 0.05 |
| IC11 | 0.15 |
| NC11 | 0.08 |
| Total | 100 |
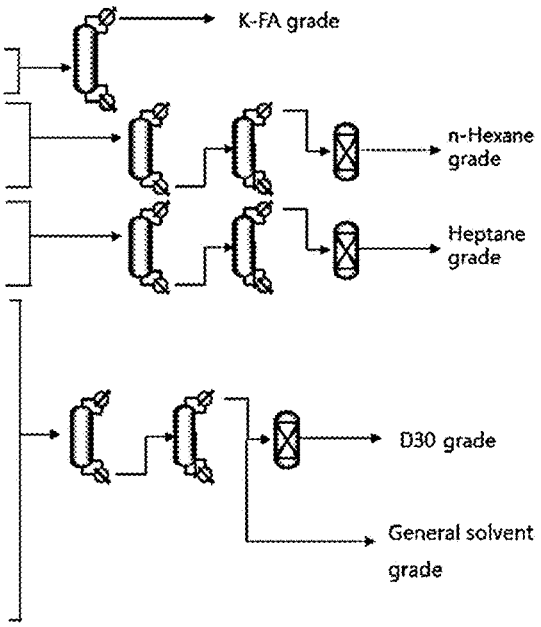
【FIG. 5】
| Component | Content, area% |
|---|---|
| IC5 | 0.07 |
| NC5 | 0.49 |
| IC6 | 1.20 |
| NC6 | 4.70 |
| CyC6 | 2.16 |
| AC6 | 0.27 |
| IC7 | 2.14 |
| NC7 | 12.02 |
| CyC7 | 7.10 |
| AC7 | 1.78 |
| IC8 | 5.58 |
| NC8 | 16.45 |
| CyC8 | 4.45 |
| AC8 | 3.55 |
| IC9 | 10.97 |
| NC9 | 13.15 |
| CyC9 | 6.86 |
| AC9 | 0.77 |
| IC10 | 1.47 |
| NC10 | 3.70 |
| CyC10 | 0.84 |
| AC10 | 0.05 |
| IC11 | 0.15 |
| NC11 | 0.08 |
| Total | 100 |
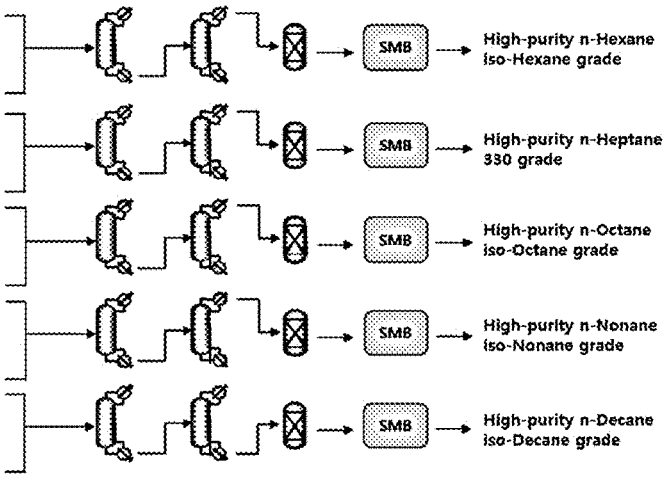

【FIG. 6】
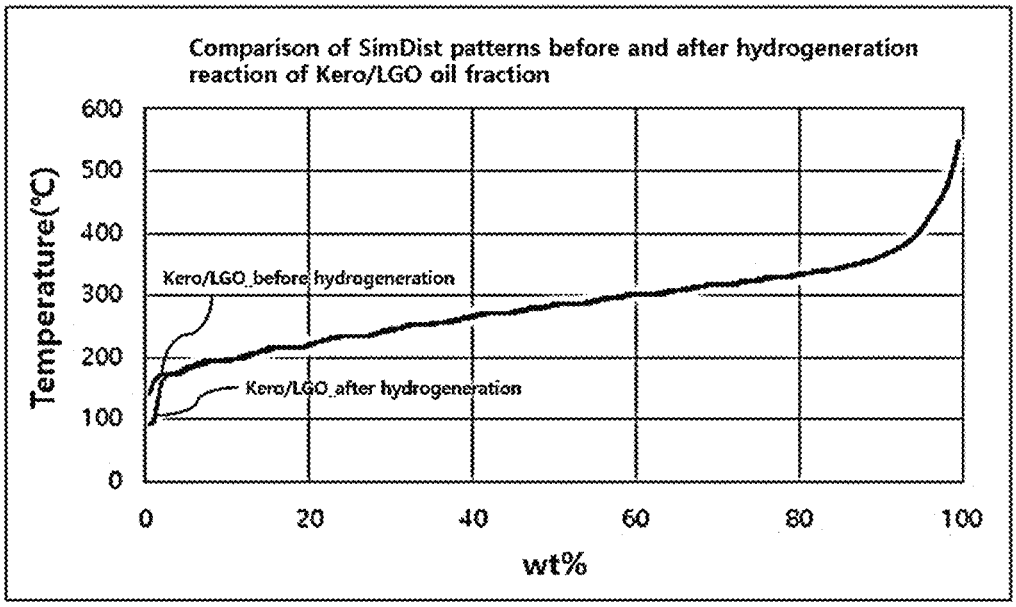

【FIG. 7】
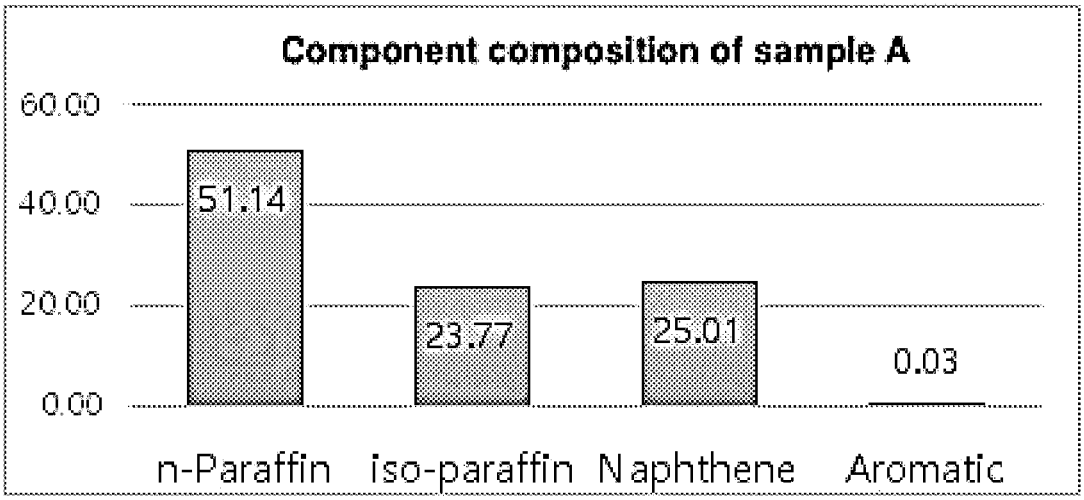
【FIG. 8】
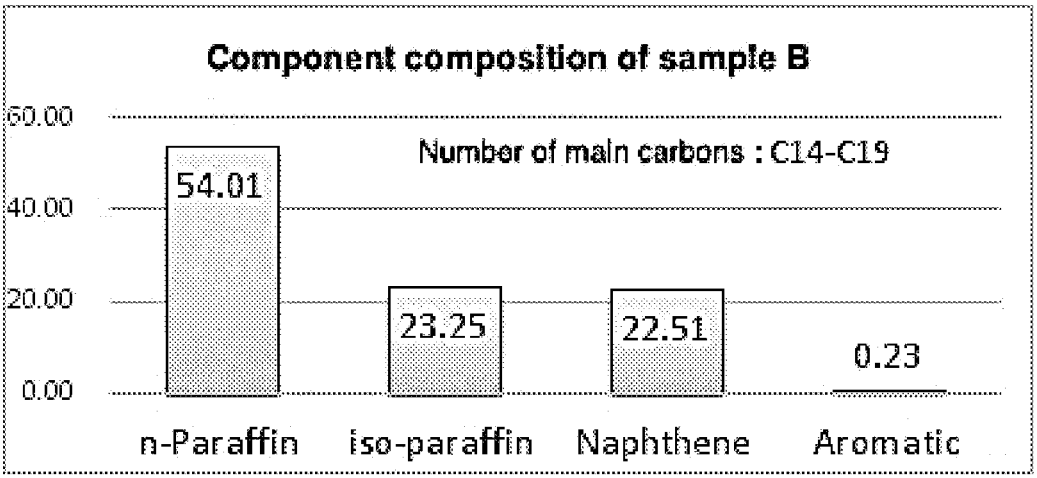

SOLVENT COMPOSITION PREPARED FROM WASTE OIL AND METHOD OF PREPARING THE SAME

CROSS-REFERENCE TO RELATED APPLICATION

This application claims priority to Korean Patent Application No. 10-2021-0051878 filed Apr. 21, 2021, the disclosure of which is hereby incorporated by reference in its entirety.

BACKGROUND OF THE INVENTION

Field of the Invention

The following disclosure relates to a solvent composition prepared from a waste oil and a method of preparing the same.

Description of Related Art

Since a large amount of impurities from a waste material is included in an oil (waste oil) produced by a cracking or pyrolysis reaction of the waste material such as a waste plastic pyrolysis oil, when the waste oil is discarded or burned, it may be converted to hazardous gas such as greenhouse gas, or $SO_x$, $NO_x$, or Cl-containing gas.

Meanwhile, since conventional petroleum-based solvent compositions are products obtained by distilling low-boiling point hydrocarbon-based materials (C6-C10) in naphtha used in a petrochemical process and include high contents of an isoparaffin and a naphthene, it is difficult to adjust a content of a normal paraffin, and it is difficult to apply the solvent composition in practice due to its high production costs.

Accordingly, since impurities in the waste oil are greatly removed, the waste oil has a higher content of a normal paraffin than a common petroleum-based solvent and a low content of impurities, and thus, a method of using a waste oil suitable for a solvent composition is needed.

Related Art Document 1 (JP 1994-228568 A) discloses a technology of catalytically cracking pyrolysis gas obtained by pyrolysis of a waste plastic material or a waste rubber material using a catalyst which does not cause a decreased function by hydrochloric acid, thereby obtaining a hydrocarbon oil and improving a recovery rate of the hydrocarbon oil. However, in Related Art Document 1, the components of the prepared low-boiling point hydrocarbon oil only have the composition of 33.3 wt % of C7-C8 and 42.4 wt % of C9-C10, and the characteristics of having a low content of an olefin and a high content of a normal paraffin which are required for application to a solvent composition are not disclosed.

Related Art Document 2 (U.S. Ser. No. 15/085,445) discloses a technology of melting waste plastic to prepare a liquid hydrocarbon stream; performing a hydrogenation reaction under a hydroprocessing catalyst to prepare C5+ liquid hydrocarbons; performing dechlorination to a content of a chlorine compound of less than 3 ppm; and manufacturing a high value product in a steam cracker. However, in Related Art Document 2, the manufactured hydrocarbon product has a composition of PIONA (20/20/0/30/30), and it is difficult to use a hydrocarbon product containing a low content of a normal paraffin as a solvent composition.

Related Art Document 3 (JP 2019-519257) is a technology of adding value to a waste oil and relates to a method of producing olefins and aromatics. It is a technology of melting waste plastic to prepare pyrolysis oil by catalytic cracking, treating gases directly with a cracker, and subjecting a liquid to a hydrogenation treatment and then a cracker/reforming treatment to prepare light olefins such as C3 and C4 and aromatics. However, Related Art Document 3 has high investment costs due to the application of catalytic cracking technology. In addition, the oil subjected to hydrogenation is mostly a light oil due to the nature of the oil prepared by catalytic cracking, so that it is difficult to the oil as a solvent composition, and the oil has a high content of an olefin and consumes much $H_2$ in the hydrogenation, so that it is difficult to secure economic feasibility.

SUMMARY OF INVENTION

Technical Problem

Since there is a large amount of impurities such as olefins, chlorine (Cl), sulfur (S), and nitrogen (N) in a pyrolysis oil of a waste oil, it is necessary to remove the impurities for application to petrochemicals. Thus, an embodiment of the present invention is directed to decrease a content of impurities after dechlorination and a hydrogenation reaction to a level low enough to be introduced to a manufacturing process of petrochemicals.

In addition, in the present invention, when a waste plastic pyrolysis oil is used as a raw material, a solvent composition having a higher content of a normal paraffin than a conventional oil prepared by refining crude oil is prepared, thereby securing economic feasibility without a yield loss.

Solution to Problem

In one general aspect, a method of preparing a solvent composition from a waste oil includes: (a) separating at least a part of a waste oil into a first oil and a second oil, wherein the first oil has a boiling point of lower than 340° C. and the second oil has a boiling point of 340° C. or higher; (b) reacting at least a part of the first oil to remove chlorine; and (c) hydrogenating the dechlorinated first oil.

The waste oil may include a waste plastic pyrolysis oil, a biomass pyrolysis oil, a regenerated lubricating oil, a crude oil having a high chlorine content, or a mixture thereof.

In the process (b), the first oil may include 30 to 90 wt % of normal paraffin, 0.1 to 30 wt % of isoparaffin, 0.1 to 90 wt % of olefins, 0.1 to 20 wt % of a naphthene, and 0.1 to 20 wt % of an aromatic compound, with respect to the total weight.

The first oil may include H-naphtha (~C8, bp<150° C.) and Kero/LGO (C9-C20, pb 150-340° C.) at a weight ratio of 1:1 to 1:10.

In the process (b), a mixture of the first oil and a solid acid material may be prepared, and the mixture may be reacted to remove chlorine.

In the process (c), the dechlorinated first oil may include less than 10 ppm of chlorine and 0.1 to 40 wt % of an olefin, with respect to the total weight.

The hydrogenation process (c) is carried out in the presence of a hydrogenation catalyst under a hydrogen atmosphere, and the hydrogenation catalyst may include (i) one or more hydrogenation metal components selected from the group consisting of VIB group metals and VIII group metals, and (ii) a carrier which is alumina, silica, silica-alumina, titanium oxide, a molecular sieve, zirconia, aluminum phosphate, carbon, niobia, or a mixture thereof.

The hydrogenation Process (c) may satisfy the following Relation 1:

$$0.95<A/B<1.05 \quad \text{[Relation 1]}$$

wherein A and B are weight average molecular weights of dechlorinated first oils before and after hydrogenation.

The hydrogenation process (c) is characterized in that 3 wt % or less of a vapor is produced with respect to the total weight of the dechlorinated first oil.

In another general aspect, a solvent composition prepared from a waste oil includes: H-naphtha (~C8, bp<150° C.) and Kero/LGO (C9-C20, bp 150-340° C.) at a weight ratio of 1:1 to 1:10), 35 to 90 wt % of a paraffin, 0.1 to 30 wt % of a naphthene, and 0 to 10 wt % of an aromatic compound.

The solvent composition may include 30 to 60 wt % of a normal paraffin, 5 to 40 wt % of an isoparaffin, 0.1 to 30 wt % of a naphthene, and 0 to 10 wt % of an aromatic compound.

The solvent composition may include 60 to 80 wt % of a normal paraffin, 10 to 30 wt % of an isoparaffin, 1 to 15 wt % of a naphthene, and a balance of an aromatic compound, with respect to 100 wt % of a C6 component.

The solvent composition may include 40 to 60 wt % of a normal paraffin, 5 to 25 wt % of an isoparaffin, 30 to 45 wt % of a naphthene, and a balance of an aromatic compound, with respect to 100 wt % of a C7 component.

The solvent composition may include less than 3 wt % of an olefin and 0.5 wt % or less of a conjugated diolefin.

The solvent composition may include less than 10 ppm of chlorine (Cl), less than 10 ppm of sulfur (S), and less than 10 ppm of nitrogen (N).

Advantageous Effects of Invention

Impurities such as Cl, S, N, and metals are removed from an oil having a boiling point of 340° C. or lower in a waste oil having a high content of Cl and hydrogenation is carried out to recover an oil, and the oil may be applied as a solvent.

Since the solvent product manufactured by the present invention has a higher content of a n-paraffin than a general petroleum-based solvent and a low content of impurities, the solvent product has high quality as a solvent.

Since a waste oil, which, when discarded or burned, may be converted into greenhouse gas or hazardous gas such as $SO_x$, $NO_x$, and Cl-containing gases, is converted into a widely used industrial solvent, the present invention is preferred also in terms of environmental protection.

BRIEF DESCRIPTION OF DRAWINGS

FIG. 1 is a schematic diagram of a method of preparing a solvent composition from a waste oil, according to an exemplary embodiment of the present invention.

FIGS. 2 and 3 are graphs representing compositions by carbon by GC-MS analysis, for naphtha recovered after hydrogenation in Example 2-4.

FIGS. 4 and 5 are results confirming that naphtha recovered after hydrogenation in Example 2-4 may be applied as a solvent product by cutting.

FIG. 6 is a graph in which SimDist analysis results before and after hydrogenation in Example 2-7 were compared.

FIGS. 7 and 8 are graphs in which compositions of oils of hydrogenated Kero/LGO samples A and B which were recovered in Example 2-8 were analyzed.

DESCRIPTION OF THE INVENTION

Unless otherwise defined herein, all terms used in the specification (including technical and scientific terms) may have the meaning that is commonly understood by those skilled in the art. Throughout the present specification, unless explicitly described to the contrary, "comprising" any elements will be understood to imply further inclusion of other elements rather than the exclusion of any other elements. In addition, unless explicitly described to the contrary, a singular form includes a plural form herein.

In the present specification, "A to B" refers to "A or more and B or less", unless otherwise particularly defined.

In addition, "A and/or B" refers to at least one selected from the group consisting of A and B, unless otherwise particularly defined.

In the present specification, unless otherwise defined, boiling points (bp) of a first oil and a second oil refer to those measured at normal pressure (1 atm).

A method of preparing a solvent composition from a waste oil according to an exemplary embodiment of the present invention is provided. The method includes: (a) separating at least a part of a waste oil into a first oil and a second oil, characterized in that the first oil has a boiling point of lower than 340° C. and the second oil has a boiling point of 340° C. or higher; (b) reacting at least a part of the first oil to remove chlorine; and (c) hydrogenating the dechlorinated first oil.

The separation process (a) is a process of separating at least a part of a waste oil into a first oil and a second oil, and a known fractional distillation method such as atmospheric distillation and reduced pressure distillation may be applied.

The separated first oil has a boiling point of less than 340° C. and may include a C5-C25 oil. Specifically, the first oil may include H-naphtha (heavy naphtha) (~C8, bp<150° C.) and Kero/LGO (C9-C20, bp 150-340° C.) at a weight ratio of 1:1 to 1:10, at a weight ratio of 1:1 to 1:8, at a weight ratio of 1:1 to 1:5, or at a weight ratio of 1:1 to 1:3.5. The first oil used in the present invention may by an oil which has not undergone oil hardening by catalytic cracking in the preparation of waste plastic pyrolysis oil, thereby preparing the paraffin-based solvent composition desired in the present invention in a high yield.

The first oil may include 30 to 90 wt % of a normal paraffin, 0.1 to 30 wt % of an isoparaffin, 0.1 to 90 wt % of olefins, 0.1 to 20 wt % of a naphthene, and 0.1 to 20 wt % of an aromatic compound, and preferably, may include 40 to 70 wt % of a normal paraffin, 0.1 to 10 wt % of an isoparaffin, 5 to 60 wt % of olefins, 0.1 to 5 wt % of a naphthene, and 0.1 to 5 wt % of an aromatic compound.

In addition, the first oil may include 1 to 5000 ppm of Cl, 1 to 1000 ppm of S, and 10 to 5000 ppm of N, and preferably 5 to 300 ppm of Cl, 5 to 100 ppm of S, and 10 to 1000 ppm of N, as the impurities.

The first oil having a boiling point range of less than 340° C. is unfavorable for application as a product as compared with a second oil having a boiling point range of 340° C. or higher, since the first oil has a higher content of impurities than an average content of impurities in a pyrolysis oil and has a higher olefin ratio, but by applying a preparation method according to an exemplary embodiment of the present invention, the paraffin-based solvent desired in the present invention may be prepared.

The second oil has a boiling point of 340° C. or higher and may include a C26+ oil. The second oil is mainly formed of a linear hydrocarbon, and a paraffin and olefin content ratio changes depending on the preparation method of a pyrolysis oil, but usually, a paraffin ratio may be higher. A small amount of a branched hydrocarbon may be included, and small amounts of naphthene and aromatics caused by a pyrolysis oil raw material may be included. Since most of the second oil is C26 or higher linear hydrocarbons, it may be present as a solid at room temperature. Though the content of impurities is lower than that in the first oil, further impurity removal treatment may be needed for application as a product. Since the second oil is in the form of wax, it may be applied as a raw material for being converted into a lubricating base oil by a structural isomerization after removing impurities (such as Cl, N, and S) which may cause catalyst deactivation and process abnormality according to process standards, or converted into a petrochemical material having a smaller molecular weight by a second treatment such as cracking.

The reason why the first oil and the second oil are separated is that the solvent product area to be applied in the present invention is mostly a hydrocarbon having a small molecular weight of Kero/LGO or less. Since a medium-high hydrocarbon of C26 or higher has good lubricity but low meltability, it may not be suitable for use as a solvent. The object of the present invention is to separate a hydrocarbon having a boiling point range to a Kero/LGO area where a solvent product group is present separately and apply the separated hydrocarbons as a solvent after a post-treatment.

Meanwhile, the waste oil may include a waste plastic pyrolysis oil, a biomass pyrolysis oil, a regenerated lubricating oil, a crude oil having a high chlorine content, or a mixture thereof. Since a large amount of impurities produced from a waste material is included in the waste oil produced by a cracking or pyrolysis reaction of the waste material such as a waste plastic pyrolysis oil, when the waste oil is used, air pollutants may be released, and in particular, a Cl component may be converted into HCl and released in a high temperature treatment process, and thus, it is necessary to pretreat the waste oil to remove impurities.

In addition, the waste oil may include H-Naphtha (~C8, bp<150° C.) and Kero/LGO (C9-C20, bp 150-340° C.): VGO/AR (C21~, bp>340° C.) at a weight ratio of 50:50 to 90:10, a weight ratio of 50:50 to 80:20, at a weight ratio of 50:50 to 70:30, or at a ratio of 50:50 to 60:40. The waste oil used in the present invention may by an oil which has not undergone oil hardening by catalytic cracking in the preparation of waste plastic pyrolysis oil, thereby preparing the paraffin-based solvent composition desired in the present invention in a high yield.

The chlorine removal process (b) is to react at least a part of the first oil to remove chlorine, in which the first oil and a solid acid material are mixed to prepare a mixture, and the prepared mixture may be reacted to remove chlorine.

A reaction of removing chlorine in an oil having a high content of chlorine may be largely classified into two types. In one type, chlorine in a hydrocarbon structure may be converted into HCl through a reaction by an active site of a solid acid catalyst, and then converted into HCl or HCl and a small amount of organic Cl and discharged. In the other type, Cl may be directly bonded to an active site of the solid acid material and removed. However, the conventional technology to remove Cl by $H_2$ feeding in a hydrotreating (HDT) process and the like may be removal of organic Cl in an oil vapor form, since a cracked waste oil may react with Cl by a hydrogenation reaction to form organic-Cl. Thus, it is not preferred since gas occurrence is increased, so that product loss is large, and an olefin component content in the waste oil may be increased. The Cl removal reaction of the present invention may not be performed in a hydrogen atmosphere (hydrotreating, HDT) and may not include a hydrogenation process. Thus, the problems of the conventional technology may be prevented.

The reaction conditions may be a pressure of 1 bar or more and 100 bar or less under an inert gas atmosphere and a temperature of 200° C. or higher and lower than 380° C. Specifically, the process conditions may be performed under pressure conditions of 1 to 100 bar of $N_2$, 1 to 60 bar of $N_2$, or 1 to 40 bar of $N_2$. When the reaction is carried out under high vacuum or low vacuum conditions of less than 1 bar, a catalytic pyrolysis reaction occurs to decrease the viscosity and the molecular weight of the pyrolysis oil and change the composition of the oil product. In particular, Cl is bonded to an olefin to form organic Cl to be removed, thereby causing a product loss. However, when the pressure is more than 100 bar, operation of the reactor is difficult and process costs are increased, which is thus not preferred. Meanwhile, the chlorine removal reaction may be carried out under inert gas conditions, not under a hydrogen atmosphere. Thus, as described above, since the content of an olefin component included in the waste oil is decreased and formation of organic-Cl is suppressed, there is no change in the composition of the oil by boiling points before/after the hydrogenation reaction in the process (c) after the chlorine removal reaction, and thus, a solvent composition having a high content of a normal paraffin may be prepared in a high yield.

In addition, the temperature conditions of the reaction may be 200 to 380° C., 230 to 360° C., 240 to 340° C., or 260 to 335° C., preferably 260 to 280° C. or 295 to 335° C. In the temperature range described above, as the temperature raises, a Cl reduction effect may be increased. Specifically, operation at a low temperature of lower than 200° C. may greatly decrease a conversion catalytic reaction in which chlorine (Cl) contained in the waste oil is converted into hydrochloric acid (HCl). Thus, since increases in a catalyst content, reaction temperature/time, and the like for compensating for low Cl reduction performance are needed, it is somewhat disadvantageous to the treatment of the waste oil having a high content of Cl in terms of economic feasibility. In addition, operation at a high temperature of higher than 380° C. may decrease an oil yield due to the occurrence of gas components by cracking reaction activation.

The solid acid material includes a Bronsted acid, a Lewis acid, or a mixture thereof, and specifically, may be a solid material in which a Bronsted acid site or a Lewis acid site is present, and the solid acid material may be zeolite, clay, silica-alumina-phosphate (SAPO), aluminum phosphate (ALPO), metal organic framework (MOF), silica alumina, or a mixture thereof.

Meanwhile, the solid acid material is a solid material having a site capable of donating $H^+$ (Bronsted acid) or accepting a lone pair of electrons (Lewis acid), and allows derivation of various reactions such as cracking, alkylation, and neutralization depending on energy at an acid site. In the present invention, the solid acid material is activated in specific process conditions, thereby carrying out a catalytic conversion reaction to convert Cl into HCl. As a result, a high content of Cl in the waste oil may be reduced to a several ppm level, and product abnormality (for example, cracking) and a yield loss (in the case in which Cl is removed as organic Cl, the case in which the oil is cracked and removed as gas, and the like) may be minimized.

As the solid acid material, waste zeolite, waste clay, and the like which are discarded after use in a petrochemical process are used as they are or used after a simple treatment for further activity improvement. For example, a fluidized bed catalyst is used in a RFCC process in which a residual oil is converted into a light/middle distillate, and in order to maintain the entire activity of the RFCC process constant, a certain amount of catalyst in operation is exchanged with a fresh catalyst every day, and the exchanged catalyst herein is named RFCC equilibrium catalyst (E-Cat) and discarded entirely. RFCC E-Cat may be used as the solid acid material of the present invention, and RFCC E-Cat may be formed of 30 to 50 wt % of zeolite, 40 to 60 wt % of clay, and 0 to 30 wt % of other materials (alumina gel, silica gel, functional material, and the like). By using RFCC E-Cat as the solid acid material for reducing Cl in the waste oil having a high content of Cl, a difference in cracking activity is small as compared with the fresh catalyst, and costs are reduced through environmental protection and reuse.

A simple treatment may be needed in order to use the waste zeolite, the waste clay, and the like as the solid acid material of the process of the present invention, and when a material such as coke or oil physically blocks the active site of the solid acid material, the material may be removed. In order to remove coke, air burning may be performed or a treatment with a solvent may be performed for oil removal. If necessary, when the metal component affects the active site of the solid acid material and deactivates the active site, a DeMet process in which a weak acid or dilute hydrogen peroxide is treated at a medium temperature to remove the metal component may be applied.

In the process (b), the solid acid material may be included at 5 to 10 wt %, preferably 7 to 10 wt %, and more preferably 8 to 10 wt %, with respect to the total weight of the mixture. Within the range, as the amount of the solid acid material introduced is increased, a Cl removal effect is improved, and when the amount is 10 wt % or less, a cracking reaction in the oil may be suppressed.

In the process (b), the dechlorinated first oil may include less than 10 ppm, 9 ppm or less, 8 ppm or less, or 7 ppm or less of chlorine, with respect to the total weight. Within the range of the chlorine content, in the hydrogenation process (c), production of organic Cl in an oil vapor form may be suppressed, production of organic-Cl by a reaction between a cracked waste oil and Cl may be suppressed, and an increase in the content of the olefin component may be suppressed. Thus, a solvent composition having a high content of a normal paraffin may be prepared in a high yield.

The dechlorinated first oil may include 0.1 to 40 wt %, 1 to 20 wt %, or 2 to 10 wt % of an olefin, with respect to the total weight. As the olefin content is higher, an amount of $H_2$ consumed to be used in saturation in the hydrogenation step is increased, so that it is disadvantageous to secure economic feasibility.

When Cl is removed from the waste oil according to the present invention, the average molecular weight and/or the viscosity of the waste oil composition may be slightly increased by an oligomerization reaction of an olefin and an alkylation reaction between the olefin and a branched paraffin in the waste oil, and thus, reaction abnormality, deterioration of product properties, and product loss may be prevented.

In addition, the dechlorinated first oil may include 0.5 wt % or less of a conjugated diolefin with respect to the total weight. A conjugated diolefin in the olefin may cause abnormal operation by gum occurrence during an operation process. In the present invention, the content of the conjugated diolefin may be decreased from 3 wt % or more to 0.5 wt % or less with respect to the total weight of the first oil by the reaction of the process (b). Thus, the criteria of 1 wt % or less of the conjugated diolefin which are stable operation criteria are generally satisfied, thereby increasing stability in the process operation.

Subsequently, the process (c) is for removing an olefin from the oil, and is a process of hydrogenating the dechlorinated first oil.

In the present invention, chlorine is removed without hydrogenation in the process (b), and then the hydrogenation process (c) is carried out, so that the contents of chlorine and olefines in the oil may be decreased to a very small amount and also, abnormal reaction, deteriorated product properties, and a product loss are prevented, thereby preparing a solvent composition having a high content of a paraffin, in particular, a high content of a normal paraffin.

The hydrogenation process (c) may be carried out in the presence of a hydrogenation catalyst under a hydrogen atmosphere, and the hydrogenation catalyst may include (i) one or more hydrogenation metal components selected from the group consisting of VIB group metals and VIII group metals, and (ii) a carrier which is alumina, silica, silica-alumina, titanium oxide, a molecular sieve, zirconia, aluminum phosphate, carbon, niobia, or a mixture thereof.

For application as a solvent product, the olefin in the product should be saturated by hydrogenation to be converted into a paraffin. Meanwhile, for more description of the process embodiment of the hydrogenation, the liquid hydrogenation process may be carried out using a fixed bed reactor. Specifically, hydrogenation may be performed by continuously injecting the liquid first oil into a fixed bed reactor filled with a hydrogenation catalyst and hydrogen in a counter-current direction or a co-current direction, but the present invention is not limited thereto.

The hydrogenation process may be carried out at 25 to 500° C. or 120 to 500° C. at a $H_2$ partial pressure of 15 to 250 bar or 15 to 200 bar.

The hydrogenation catalyst may include a noble metal-based catalyst or a MoS-based catalyst requiring sulfuration. Since a zeolite-based catalyst is not used as in the conventional art, formation of a light olefin such as C3 and C4 and aromatics is suppressed, and a solvent composition including ~C8 H-naphtha oils and C9-C20 Kero/LGO oils may be prepared.

A hydrogenation reaction by a precious metal catalyst may use a catalyst in the form of a metal catalyst supported on a carrier. Here, the metal catalyst may be nickel (Ni), platinum (Pt), palladium (Pd), rhodium (Rh), lutetium (Lu), or an alloy including two or more thereof, and the alloy may be, for example, a platinum-palladium alloy. The carrier may be alumina ($Al_2O_3$), silica ($SiO_2$), titania ($TiO_2$), zirconia ($ZrO_2$), zeolite, clay materials, or a combination thereof, but the present invention is not limited thereto. In addition, the amount of the metal catalyst supported may be 0.1 to 15 wt %, and more specifically 0.3 to 3 wt %, with respect to 100 wt % of the catalyst. The hydrogenation process using the precious metal catalyst may be performed at a hydrogen partial pressure of 15 to 200 bar at a temperature of 25 to 200° C.

To the MoS-based catalyst, Ni, Co, and the like may be selectively introduced as a cocatalyst metal, and if necessary, two metals may be used in combination. A W metal may be used instead of Mo, and likewise, Mo and W may be used in combination. If necessary, the metal content and the catalyst pore distribution are adjusted to prepare a metal catalyst having a different reaction activity and may be adjusted to one reactor or each of sequential reactors separately. The content of the metal catalyst (Mo or W) may be 0.1 to 95 wt %, and more specifically 0.3 to 20 wt %, with respect to 100 wt % of the catalyst. Ni, Co, and the like is usually supported at a low content as compared with Mo, but, if necessary, may be supported at a content similar to or higher than Mo. The hydrogenation process using the MoS-based catalyst may be carried out at a hydrogen partial pressure of 15 to 250 bar at a temperature of 25 to 400° C.

The hydrogenation process (c) of the present invention may produce 3 wt % or less, 1 wt % or less, preferably 0.1 to 1 wt % of oil vapor with respect to the total weight of the dechlorinated first oil. The oil vapor produced in the hydrogenation reaction using a hydrocracking catalyst including zeolite of the conventional technology is in a level of 10 wt % or more, but in the present invention, a hydrotreating catalyst is used and an oil having reduced contents of impurities (chlorine) and olefin is used as a raw material to suppress occurrence of oil vapor, and thus, the solvent composition desired in the present invention may be prepared in a high yield.

Meanwhile, the oil vapor refers to a state in which oil droplets having a particle size of 1 to 10 μm are evaporated to be distributed in the form of fog, and the composition of the oil vapor may be light hydrocarbons such as $H_2$, C1-C4 hydrocarbons, organic-Cl.

The hydrogenation process of the present invention may satisfy the following Relation 1:

$$0.95<A/B<1.05 \quad \text{[Relation 1]}$$

wherein A and B are weight average molecular weights of dechlorinated first oils before and after hydrogenation.

As described above, the molecular weight distribution (boiling point distribution) in the dechlorinated first oil before and after the hydrogenation may be maintained at a constant level, thereby preparing a solvent composition to be desired including ~C8 H-naphtha oils and a C9-C20 Kero/LGO oils.

In the present invention, as described above, production of organic Cl in an oil vapor form may be suppressed in the hydrogenation process (c), and a conventional problem of producing organic-Cl by a reaction between a cracked waste oil and Cl may be improved.

A method of preparing a solvent composition from a waste oil according to an exemplary embodiment of the present invention may further include: (c) a pretreatment hydrogenation process of selectively removing a conjugated diolefin in the olefin before the hydrogenation process.

The conjugated diolefin may be converted into gum and the like by forming an oligomer during a reaction process to derive operation trouble. Thus, it is preferred that a pretreatment hydrogenation process of selectively removing the conjugated diolefin from the oil, if necessary, depending on its content is performed before the hydrogenation process (c).

The pretreatment hydrogenation process may be carried out at 40 to 300° C. and at a $H_2$ partial pressure of 5 to 100 bar. Since the conjugated diolefin may be removed easily as compared with the cases of removal of an unsaturated double bond and removal of impurities such as S and N, the pretreatment hydrogenation process operation conditions may be milder than the hydrogenation process operation conditions.

Meanwhile, the catalyst used in the pretreatment hydrogenation process may be a noble metal or MoS-based catalyst which is similar to the catalyst of the hydrogenation process (c). Specifically, when the content of impurities in the oil prepared in the dechlorination process (b) is low, a noble metal catalyst is applied to carry out a pretreatment hydrogenation process. Here, when a Pd/r-$Al_2O_3$ catalyst is applied as an example of the noble metal catalyst, the conjugated diolefin may be sufficiently selectively removed even under mild conditions of 40 to 150° C. and a $H_2$ partial pressure of 10 to 40 bar. In addition, when a MoS-based catalyst is used, the temperature and the hydrogen pressure are somewhat higher as compared with the operation conditions of the noble metal catalyst, but the pretreatment hydrogenation process may be carried out even under the conditions of lower temperature and hydrogenation pressure than the hydrogenation reaction (c).

Meanwhile, the pretreatment hydrogenation process may be carried out, specifically, after the dechlorination process (b) and before the hydrogenation process (c), and thus, a problem in the conventional technology in which Cl is removed by $H_2$ feeding in a hydrotreating (HDT) process and the like, which is a waste oil being cracked and removed in an organic-Cl form, may be prevented.

Hereinafter, the hydrogenation process and the process embodiment of the pretreatment hydrogenation will be further described. The (pretreatment) hydrogenation process may be, as an example, a liquid hydrogenation process, and may be carried out in a fixed bed reactor. Specifically, the hydrogenation process may be hydrogenation by continuously injecting the liquid first oil into a fixed bed reactor filled with a hydrogenated catalyst and hydrogen in a counter-current or co-current direction. However, the present invention is not limited thereto.

Another exemplary embodiment of the present invention provides a solvent composition prepared from the waste oil.

The solvent composition may be a solvent composition prepared by the method of preparing a solvent composition from a waste oil according to an exemplary embodiment.

The solvent composition may include H-naphtha (heavy naphtha) (~C8, bp<150° C.) and Kero/LGO (C9-C20, bp 150-340° C.) at a weight ratio of 1:1 to 1:10, specifically at a weight ratio of 1:1 to 1:8, at a weight ratio of 1:1 to 1:5, or at a weight ratio of 1:1d to 1:3.5.

The solvent composition may include 35 to 90 wt % of a paraffin, 0.1 to 30 wt % of a naphthene, and 0 to 10 wt % of an aromatic compound, specifically 50 to 90 wt % of a paraffin, 10 to 30 wt % of a naphthene, and 0 to 9 wt % of an aromatic compound, 60 to 85 wt % of a paraffin, 15 to 30 wt % of a naphthene, and 0 to 8 wt % of an aromatic compound, or 65 to 80 wt % of a paraffin, 10 to 30 wt % of a naphthene, and 0 to 8 wt % of an aromatic compound, with respect to the total weight.

The solvent composition is characterized by including 30 to 60 wt % of a normal paraffin, 5 to 40 wt % of an isoparaffin, 0.1 to 30 wt % of a naphthene, and 0 to 10 wt % of an aromatic compound. Specifically, the solvent composition may include 40 to 60 wt % of a normal paraffin, 10 to 30 wt % of an isoparaffin, 10 to 25 wt % of a naphthene, and 0 to 10 wt % of an aromatic compound, and preferably, may include 50 to 60 wt % of a normal paraffin, 15 to 25 wt % of an isoparaffin, 15 to 25 wt % of a naphthene, and 0 to 10 wt % or 0 to 5 wt % of an aromatic compound.

The solvent composition may include 60 to 80 wt % of a normal paraffin, 10 to 30 wt % of an isoparaffin, 1 to 15 wt % of a naphthene, and a balance of an aromatic compound, with respect to 100 wt % of a C6 component. Specifically, the solvent composition may include 65 to 80 wt % of a normal paraffin, 15 to 30 wt % of an isoparaffin, 5 to 10 wt % of a naphthene, and a balance of an aromatic compound.

The solvent composition may include 40 to 60 wt % of a normal paraffin, 5 to 25 wt % of an isoparaffin, 30 to 45 wt % of a naphthene, and a balance of an aromatic compound, with respect to 100 wt % of a C7 component. Specifically, the solvent composition may include 45 to 60 wt % of a normal paraffin, 10 to 25 wt % of an isoparaffin, 30 to 40 wt % of a naphthene, and a balance of an aromatic compound.

The solvent composition may include 35 to 55 wt % of a normal paraffin, 20 to 40 wt % of an isoparaffin, 30 to 50 wt % of a naphthene, and a balance of an aromatic compound, with respect to 100 wt % of a C8 component. Specifically, the solvent composition may include 40 to 55 wt % of a normal paraffin, 25 to 40 wt % of an isoparaffin, 30 to 40 wt % of a naphthene, and a balance of an aromatic compound.

The solvent composition may include 45 to 65 wt % of a normal paraffin, 10 to 30 wt % of an isoparaffin, 15 to 35 wt % of a naphthene, and a balance of an aromatic compound, with respect to 100 wt % of a C9 component. Specifically, the solvent composition may include 50 to 65 wt % of a normal paraffin, 15 to 30 wt % of an isoparaffin, 15 to 30 wt % of a naphthene, and a balance of an aromatic compound.

The solvent composition may include 50 to 70 wt % of a normal paraffin, 10 to 30 wt % of an isoparaffin, 10 to 30 wt % of a naphthene, and a balance of an aromatic compound, with respect to 100 wt % of a C10 component. Specifically, the solvent composition may include 55 to 70 wt % of a normal paraffin, 15 to 30 wt % of an isoparaffin, 10 to 25 wt % of a naphthene, and a balance of an aromatic compound.

The solvent composition may include less than 3 wt %, less than 1 wt %, or less than 0.1 wt % of olefins and 0.5 wt % or less of conjugated diolefins. In addition, the solvent composition may include less than 10 ppm or less than 5 ppm of chlorine (Cl), less than 10 ppm or less than 3 ppm of sulfur (S), and less than 10 ppm or less than 3 ppm of nitrogen (N).

Hereinafter, the preferred Examples and Comparative Examples of the present invention will be described. However, the following Examples are only a preferred exemplary embodiment of the present invention, and the present invention is not limited thereto.

Example 1. Composition Analysis of Waste Oil (Waste Plastic Pyrolysis Oil) Having High Content of Cl and Separation of Naphtha and Kero/LGO Therefrom A plastic waste was pyrolyzed to obtain a waste oil (waste plastic pyrolysis oil), and the obtained waste oil was used as a raw material for solvent preparation. In order to confirm the effect of impurity removal by the reaction and a molecular weight change, the following analysis was performed. In order to confirm a molecular weight distribution in the waste plastic pyrolysis oil, GC-SimDist analysis (HT-750) was performed. ICP, TNS, EA-O, and XRF analyses were performed for analysis of the impurities, Cl, S, N, and O. In addition, GC-MSD analysis was performed for analysis of olefin content. The analysis results are shown in the following Tables 1, 2, and 3:

TABLE 1

| Cut Name | Expected carbon range | Boiling point (° C.) | Yield (wt %) |
|---|---|---|---|
| H-Naphtha. | ~C8 | <150 | 8.1 |
| KERO | C9-C17 | 150~265 | 24.4 |
| LGO | C18-C20 | 265~340 | 22.7 |
| VGO/AR | C21~ | >340 | 44.8 |
| SUM | — | — | 100 |

TABLE 2

| Pyrolysis oil | Cl | N | S | O |
|---|---|---|---|---|
| mg/Kg | 67 | 348 | 20 | 0.2 |

In order to recover H-naphtha and Kero/LGO oils which may be converted into a solvent, separation was performed by boiling points by a distillation apparatus. H-naphtha was obtained by separating an oil having a boiling point of lower than 150° C. at normal pressure, and a Kero/LGO mixture was obtained by separating an oil having a boiling point of 150 to 340° C. by reduced pressure distillation.

Hydrogenation process introduction criteria were determined on the basis of Cl which is an impurity causing the most serious problem in the hydrogenation process. This is because a representative impurity which may cause device corrosion by HCl conversion is Cl, and the impurities other than Cl, such as N, S, O, and metals, are also removed simultaneously in the impurity reduction process. The content of Cl in the separated naphtha and Kero/LGO fraction is shown in the following Table 3:

TABLE 3

| | Cl (wppm) |
|---|---|
| Naphtha | 154 |
| Kero/LGO | 68 |

Example 2. Cl Reduction Reaction in Oil by Treating Solid Acid Material at High Temperature

Example 2-1. Preparation of Solid Acid Material

In order to remove Cl in the liquid pyrolysis oil of Example 1, a solid acid material was prepared. The solid acid material was a material having a Bronsted or Lewis acid site, and RFCC E-cat. was used. The physical properties of the RFCC E-cat used are shown in the following Table 4. In addition, the contents of impurities included in the catalyst are shown in Table 5.

TABLE 4

| Type | TSA ($m^2/g$) | ZSA ($m^2/g$) | MSA ($m^2/g$) | Z/M Ratio | PV (cc/g) | APD (Å) |
|---|---|---|---|---|---|---|
| RFCC E-cat | 122 | 36 | 86 | 0.42 | 0.20 | 67 |

In Table 4, TSA is a total specific surface area, ZSA is a zeolite specific surface area, MSA is a meso or larger pore specific surface area, Z/M is a ratio of the zeolite specific surface area (ZSA) to the meso or larger pore specific surface area (MSAQ), PV is a pore volume, and APD is an average pore diameter.

TABLE 5

| RFCC E-cat | Na | Ni | V | Fe | Mg | P | $La_2O_3$ | $CeO_2$ | $TiO_2$ | $SiO_2$ | $Al_2O_3$ |
|---|---|---|---|---|---|---|---|---|---|---|---|
| wt % | 0.13 | 0.53 | 1.21 | 0.65 | 0.07 | 0.56 | 0.69 | 0.10 | 0.78 | 40 | 53 |

The RFCC E-cat used was a catalyst having a total specific surface area of 122 $m^2/g$, a pore volume of 0.20 cc/g, and an average particle size of 79 μm.

Example 2-2. Cl Reduction in Naphtha Oil by Solid Acid Material 12 kg of the Naphtha oil recovered in Example 1 and 3.6 kg of RFCC E-cat. were introduced to a 20 L autoclave, $N_2$ purging was carried out three times, and it was confirmed that there was no leak in equipment by a leak test at 30 bar of $N_2$. Thereafter, $N_2$ was vented, the equipment was operated at 500 rpm under the conditions of 12 bar of $N_2$, and the reaction temperature was raised to 170° C. The temperature was maintained at 170° C. for 6 hours, the reaction was finished, stirring was performed, and the temperature was lowered to room temperature. Subsequently, venting was performed at room temperature, the autoclave was released to recover a reactant and a waste catalyst, and filtration was performed to recover treated naphtha. The reaction was repeated until a Cl content in naphtha was 10 wppm or less. Important changes in the physical properties related to the solvent product before and after the reaction are shown in the following Table 6:

TABLE 6

| Conditions | Cl (ppm) | Olefins (Vol %) | Diene Value | Oxygenate, ppm |
|---|---|---|---|---|
| Naphtha_before reaction | 154 | 58.29 | 11.5 | 2270 |
| Naphtha_Cl reduction | 7 | N/D unmeasurable | 0.1 | 4 |

Example 2-3. Hydrogenation of Naphtha Oil Having Reduced Impurities

The Cl-reduced naphtha oil recovered in Example 2-2 was subjected to a hydrogenation reaction in a fixed bed continuous reactor. As the catalyst, $Ni/Al_2O_3$ was selected, 10 cc of the catalyst was loaded in the fixed bed continuous reactor, and then the catalyst was activated by the following procedure. The temperature was raised to 120° C. at a rate of 2° C./min under the conditions of 300 sccm of $N_2$ normal pressure and then maintained for 2 hours to remove the impurities on the surface of the catalyst. Subsequently, the temperature was raised to 280° C. at the same heating rate under the conditions of 40 sccm of $H_2$ normal pressure, and the treatment was performed for 8 hours to perform reduction activation of the catalyst. Thereafter, the conditions were changed to a hydrogenation reaction conditions of a temperature of 90° C., 50 sccm of $H_2$, and 30 bar.

The Cl-reduced naphtha oil recovered in Example 2-2 was injected into the activated hydrogenation catalyst under the condition of LHSV 1.5 $h^{-1}$. Analysis of the Cl content, the olefin content, and oxygenate content was performed for the hydrogenated oil in the same manner as in Example 1, and the results are shown in the following Table 7:

TABLE 7

| Conditions | Cl (ppm) | Olefins (Vol %) | Diene Value | Oxygenate, ppm |
|---|---|---|---|---|
| Naphtha_before reaction | 154 | 58.29 | 11.5 | 2270 |
| Naphtha_Cl reduction | 7 | N/D | 0.1 | 4 |
| Naphtha_hydrogenation | <1 | 0.46 | 0.1 | trace |

Example 2-4. Analysis of Hydrogenated Naphtha

In order to confirm the applicability of the hydrogenated naphtha oil recovered in Example 2-3 as a solvent product, analysis of composition and physical properties was performed. The hydrogenated naphtha recovered in Example 2-3 had a content of n-paraffin of 50.59 wt % as shown in Table 8, which was confirmed to be higher than the content of n-paraffin of naphtha in the conventional petroleum-based oil of 30 to 37 wt %.

TABLE 8

| | n-Paraffin | i-Paraffin | Olefin | Naphthene | Aromatic compound | Total |
|---|---|---|---|---|---|---|
| C3 | | | | | | 0.00 |
| C4 | | | | | | 0.00 |
| C5 | 0.49 | 0.07 | | | | 0.56 |
| C6 | 4.70 | 1.20 | | 2.16 | 0.27 | 8.33 |
| C7 | 12.02 | 2.14 | | 7.10 | 1.78 | 23.04 |
| C8 | 16.45 | 5.58 | | 4.45 | 3.55 | 30.03 |
| C9 | 13.15 | 10.97 | | 6.86 | 0.77 | 31.75 |
| C10 | 3.70 | 1.47 | | 0.84 | 0.05 | 6.07 |
| C11 | 0.08 | 0.15 | | | | 0.23 |
| C12 + | | | | | | 0.00 |
| Total | 50.59 | 21.58 | 0 .00 | 21.41 | 6.42 | 100.00 |

In table 8, the content of each component is the wt % of each component with respect to 100 wt % of hydrogenated naphtha.

The compositions of full range naphtha and heavy naphtha of the petroleum-based oil are shown in the following Tables 9 and 10, respectively.

TABLE 9

| | n-Paraffin | i-Paraffin | Olefin | Naphthene | Aromatic compound | Total |
|---|---|---|---|---|---|---|
| C3 | | | | | | 0.00 |
| C4 | 0.80 | | | | | 0.80 |
| C5 | 14.19 | 10.42 | 0.03 | 1.20 | | 25.84 |
| C6 | 10.07 | 12.73 | 0.01 | 4.40 | 1.25 | 28.46 |
| C7 | 5.85 | 5.65 | 0.01 | 6.08 | 2.29 | 19.88 |
| C8 | 4.79 | 5.60 | 0.00 | 4.02 | 2.98 | 17.39 |
| C9 | 0.89 | 4.62 | 0.05 | 1.87 | 0.10 | 7.53 |
| C10 | | 0.10 | | | | 0.10 |
| C11 | | | | | | 0.00 |
| C12 + | | | | | | 0.00 |
| Total | 36.59 | 39.12 | 0.10 | 17.57 | 6.62 | 100.0 |

TABLE 10

| | n-Paraffin | i-Paraffin | Olefin | Naphthene | Aromatic compound | Total |
|---|---|---|---|---|---|---|
| C3 | | | | | | 0.00 |
| C4 | | | | | | 0.00 |
| C5 | 0.01 | | | 0.02 | | 0.03 |
| C6 | 7.61 | 3.28 | | 5.58 | 1.30 | 17.77 |
| C7 | 12.00 | 11.78 | 0.02 | 11.25 | 5.00 | 40.05 |
| C8 | 9.38 | 11.69 | 0.01 | 7.39 | 4.91 | 33.38 |
| C9 | 0.42 | 5.90 | 0.06 | 2.34 | 0.04 | 8.76 |
| C10 | | 0.01 | | | | 0.01 |
| C11 | | | | | | 0.00 |
| C12 + | | | | | | 0.00 |
| Total | 29.42 | 32.66 | 0.09 | 26.58 | 11.25 | 100.0 |

In Tables 9 and 10, the content of each component was the wt % of each component for 100 wt % of full range naphtha and heavy naphtha, respectively.

Referring to Tables 8 to 10, it was confirmed that using the oil characteristic of a high paraffin content which is unique to a pyrolysis oil, the present invention is used as a high-purity n-paraffin raw material oil or is advantageous for n-hexane and n-heptane solvent production.

The composition confirmed by 2D-GC and the content of impurities confirmed by ICP and XRF are shown in the following Tables 11 and 12. It was confirmed that the hydrogenated oil had a saturate content of 94.76%, an olefin content of 0.46%, and an aromatic compound content of 4.78%, and thus, was converted into a paraffin. It was analyzed that the impurities such as N and S with Cl were included at 1 ppm or less, respectively, Ca and Na were included at 15 ppm or less, respectively, and Fe, As, Pb, and Hg were included at 3 ppb or less, respectively.

Composition analysis by carbons was performed by GC-MS analysis for naphtha recovered after hydrogenation, and the results are shown in the following FIG. 2, FIG. 3, and Table 13.

TABLE 11

| | After HDT reaction |
|---|---|
| Oxygenates (mg/kg) | 0.0 |
| Saturates (vol. %) | 94.76 |
| Olefins (vol. %) | 0.46 |

TABLE 11-continued

| | After HDT reaction |
|---|---|
| Aromatics (vol. %) | 4.78 |
| Oxygenate (vol. %) | — |

TABLE 12

| | After HDT reaction |
|---|---|
| Cl (ppm) | trace |
| N (ppm) | <1.0 |
| S (ppm) | <1.0 |
| Ca (ppb) | 14.2 |
| Fe (ppb) | 1.9 |
| Na (ppb) | 10.2 |
| Pb (ppb) | 0.1 |
| As (ppb) | 0.9 |
| Hg (ppb) | 2.9 |

TABLE 13

| Component | Content, area % |
|---|---|
| IC5 | 0.07 |
| NC5 | 0.49 |
| IC6 | 1.20 |
| NC6 | 4.70 |
| CyC6 | 2.16 |
| AC6 | 0.27 |
| IC7 | 2.14 |
| NC7 | 12.02 |
| CyC7 | 7.10 |
| AC7 | 1.78 |
| IC8 | 5.58 |
| NC8 | 16.45 |
| CyC8 | 4.45 |
| AC8 | 3.55 |
| IC9 | 10.97 |
| NC9 | 13.15 |
| CyC9 | 6.86 |
| AC9 | 0.77 |
| IC10 | 1.47 |
| NC10 | 3.70 |
| CyC10 | 0.84 |
| AC10 | 0.05 |
| IC11 | 0.15 |
| NC11 | 0.08 |
| Total | 100 |

Example 2-5. Review of Solvent Product Possibility of Hydrogenated Naphtha

It was confirmed that the oil analyzed in Example 2-4 may be applied as a solvent product by cutting, as shown in FIGS. 4 and 5. The solvent product of FIG. 4 is the case of manufacturing a solvent product by common cutting/blending, and FIG. 5 is the case of manufacturing a solvent product by applying a simulated moving bed (SMB). When the common cutting/blending method is applied a total of five solvent products may be manufactured, and when SMB is applied, a total of 10 solvent products may be manufactured.

The composition of a C5 oil derived from a pyrolysis oil is shown in the following Table 14, and the composition of a petroleum-based C5 oil is shown in the following Table 15. Referring to Tables 14 and 15, it was confirmed that the solvent (K-FA grade) mainly formed of the C5 oil of the present invention had a higher content of the n-paraffin of the C5 oil recovered from the pyrolysis oil than that of the petroleum-based C5 oil by 6% or more. Thus, it was found that the solvent composition of the present invention is preferred in terms of the solvent physical properties.

TABLE 14

| Component name | Content (wt %) |
|---|---|
| Butane and lighter | 0 |
| n-C5 | 87.3 |
| i-C5 | 12.6 |
| Hexane and heavier | 0.1 |
| Olefin | 0 |

TABLE 15

| Component name | Content (wt %) |
|---|---|
| Butane and lighter | 0 |
| n-C5 | 81 |
| i-C5 | 18 |
| Hexane and heavier | 0.5 |
| Olefin | Max 0.1 |

The composition of a C6 oil derived from a pyrolysis oil is shown in the following Table 16, and the composition of a petroleum-based C6 oil is shown in the following Table 17. It was confirmed that the n-hexane selectivity in C6 oil derived from the pyrolysis oil was twice that of the petroleum-based C6 oil, and thus, it was found that n-hexane may be recovered in a high yield.

TABLE 16

| | Content (wt %) | |
|---|---|---|
| Component | | Normalized |
| 2,3-DIMETHYL-BUTANE | 0.16 | 1.83 |
| 2-METHYL-PENTANE | 0.71 | 8.27 |
| 3-METHYL-PENTANE | 0.34 | 3.91 |
| N-HEXANE | 4.70 | 54.74 |
| METHYLCYCLOPENTANE | 1.42 | 16.55 |
| 2,4-DIMETHYLPENTANE | 0.25 | 2.92 |
| BENZENE | 0.27 | 3.14 |
| CYCLOHEXANE | 0.74 | 8.64 |
| total | 8.59 | 100.00 |

TABLE 17

| | Content (wt %) | |
|---|---|---|
| Component | | Normalized |
| 2,3-DIMETHYL-BUTANE | 2.70 | 6.46 |
| 2-METHYL-PENTANE | 12.14 | 29.05 |
| 3-METHYL-PENTANE | 9.25 | 22.13 |
| N-HEXANE | 11.61 | 27.78 |
| 2,2-DIMETHYLPENTANE | 1.27 | 3.03 |
| METHYLCYCLOPENTANE | 1.41 | 3.38 |
| 2,4-DIMETHYLPENTANE | 1.48 | 3.54 |
| 2,2,3-TRIMETHYLBUTANE | 0.19 | 0.46 |
| 3,3-DIMETHYLPENTANE | 1.21 | 2.90 |
| CYCLOHEXANE | 0.53 | 1.27 |
| total | 41.80 | 100.00 |

Based on the compositions in Tables 16 and 17, the composition of the producible mixed C6 solvent oil is shown in the following Tables 18 and 19. The pyrolysis oil-derived mixed C6 oil solvent had a higher n-paraffin ratio than the petroleum-based mixed C6 oil by about 8%, and was confirmed to be applicable as a solvent.

TABLE 18

| Component | Content, % |
|---|---|
| n-Pentane | 0.08 |
| 2,3-Dimethylbutane | 2.45 |
| 2-Methylpentane | 10.88 |
| 3-Methylpentane | 5.21 |
| n-Hexane | 71.32 |
| Methylcyclopentane | 0.00 |
| Cyclohexane | 9.08 |
| 2-Methylhexane | 0.61 |
| 2,3-Dimethylpentane | 0.03 |
| 1,1-Dimethylcyclopentane | 0.05 |
| 3-Methylhexane | 0.13 |
| 1,3-Dimethylcyclopentane | 0.15 |
| 3-Ethylpentane | 0.01 |
| 1,2-Dimethylcyclopentane, trans | 0.00 |
| n-Heptane | 0.01 |
| n-Paraffine | 71.40 |
| iso-Paraffin | 19.32 |
| Naphthene | 9.28 |

TABLE 19

| Component | Content, % |
|---|---|
| 2,3-DIMETHYL-BUTANE | 0.01 |
| 2-METHYL-PENTANE | 0.67 |
| 3-METHYL-PENTANE | 11.83 |
| N-HEXANE | 63.00 |
| 2,2-DIMETHYLPENTANE | 5.84 |
| METHYLCYCLOPENTANE | 7.70 |
| 2,4-DIMETHYLPENTANE | 5.97 |
| 2,2,3-TRIMETHYLBUTANE | 0.68 |
| 3,3-DIMETHYLPENTANE | 0.84 |
| CYCLOHEXANE | 2.67 |
| 2-METHYLHEXANE | 0.40 |
| 2,3-DIMETHYLPENTANE | 0.17 |
| 1,1-DIMETHYLCYCLOPENTANE | 0.05 |
| 3-METHYLHEXANE | 0.13 |
| CIS-1,3-DIMETHYLCYCLOPENTANE | 0.02 |
| TRANS-1,3-DIMETHYLCYCLOPENTANE | 0.01 |
| 3-ETHYLPENTANE | 0.00 |
| TRANS-1,2-DIMETHYLCYCLOPENTANE | 0.01 |
| n-Paraffine | 63.00 |
| iso-Paraffin | 26.54 |
| Naphthene | 10.46 |

Table 20 shows the composition of the pyrolysis oil-derived C7 oil, and Table 21 shows the composition of the petroleum-based C7 oil. The C7 solvent had a higher selectivity of pyrolysis oil-derived n-heptane than the petroleum-based n-heptane by about 30 wt %, and thus, it was confirmed that n-heptane may be manufactured in a high yield by the present invention.

TABLE 20

| Component | Content, wt % | Content, Normalized % |
|---|---|---|
| 2-Methylhexane | 0.81 | 3.86 |
| 2,3-Dimethylpentane | 0.07 | 0.31 |
| 1,1-Dimethylcyclopentane | 0.03 | 0.16 |
| 3-Methylhexane | 0.84 | 3.98 |
| 1,3-Dimethylcyclopentane, cis | 0.36 | 1.73 |
| 3-Ethylpentane | 0.17 | 0.83 |
| 1,3-Dimethylcyclopentane, trans | 0.10 | 0.50 |
| 1,2-Dimethylcyclopentane, trans | 0.74 | 3.53 |

TABLE 20-continued

| Component | Content, wt % | Content, Normalized % |
|---|---|---|
| n-Heptane | 12.02 | 57.14 |
| Methylcyclohexane | 4.18 | 19.85 |
| 2,2-Dimethylhexane | 0.03 | 0.14 |
| Ethylcyclopentane | 1.68 | 7.98 |
| Total | 21.05 | 100 |

TABLE 21

| Component | Content, wt % | Content, Normalized % |
|---|---|---|
| 4-Methyl-1-Hexene | 0.05 | 0.16 |
| 2-Methylhexane | 6.97 | 21.23 |
| 2,3-Dimethylpentane | 2.67 | 8.13 |
| 1,1-Dimethylcyclopentane | 0.10 | 0.31 |
| 3-Methylhexane | 9.17 | 27.95 |
| c-1,3-Dimethylcyclopentane | 0.06 | 0.19 |
| t-1,3-Dimethylcyclopentane | 0.28 | 0.86 |
| 3-Ethylpentane | 1.41 | 4.29 |
| t-1,2-Dimethylcyclopentane | 0.39 | 1.20 |
| 1-Heptane | 0.10 | 0.31 |
| 2,2,4-Trimehylpentane | 0.11 | 0.32 |
| t-3-Heptane | 0.16 | 0.50 |
| n-Heptane | 9.23 | 28.13 |
| c-3-Heptene | 0.59 | 1.79 |
| t-2-Heptene | 0.09 | 0.28 |
| 2-Heptene | 0.23 | 0.70 |
| Methylcyclohexane | 0.51 | 1.56 |
| 2,2-Dimethyhexane | 0.42 | 1.29 |
| Ethylcyclopentane | 0.27 | 0.81 |
| Total | 32.816 | 100 |

Based on the compositions of the oils in Tables 20 and 21, the composition of the producible mixed C6 solvent oil is shown in the following Tables 22 and 23. The C7 mixed solvent also had a high naphthene content of 38% in the mixture, and thus, is advantageous in terms of solubility, had high specific gravity, and had some odor, but is considered to positively act on application performance to a reaction solvent, a paint, an adhesive, and a cleaning agent.

TABLE 22

| Component | Content, wt % |
|---|---|
| Methylcyclopentane | 5.46 |
| Cyclohexane | 0.04 |
| 2-methyl hexane | 4.26 |
| 23dimethyl pentane | 0.28 |
| 11dimethylcyclopentane | 0.12 |
| 3-methyl hexane | 3.39 |
| 13dimethylcyclopentane | 1.86 |
| 3ethyl pentane | 0.69 |
| 12dimethylcyclopentane | 2.99 |
| n-Heptane | 48.58 |
| MCH | 20.91 |
| 22dimethylhexane | 1.27 |
| Ethylcyclopentane | 6.40 |
| 24dimethylhexane | 0.31 |
| 124Trimethylcyclopentane | 0.00 |
| 2methylheptane | 3.43 |
| 4methylheptane | 0.01 |
| Total | 100 |
| n-Paraffin | 48.58 |
| iso-Paraffin | 13.64 |
| Naphthene | 37.77 |

TABLE 23

| Component | Content (wt %) |
|---|---|
| Hexane | 0.01 |
| 2,2 dimethyl pentane | 0.01 |
| 2,4 dimethyl pentane | 0.02 |
| Methylcyclopentane | 0.004 |
| 3,3 dimethyl pentane | 0.59 |
| 2-methyl hexane | 19.46 |
| 2,3-dimethyl pentane | 7.68 |
| 3-methyl hexane | 37.00 |
| 1,3-dimethylcyclopentane | 1.71 |
| 3 ethyl pentane | 4.80 |
| Isopropylcyclobutane | 1.25 |
| n-Heptane | 26.70 |
| MCH | 0.30 |
| Ethylcyclopentane | 0.10 |
| Other C7 isomers | 0.37 |
| Total | 100.00 |

TABLE 23-continued

| Component | Content (wt %) |
|---|---|
| n-Paraffin | 26.71 |
| iso-Paraffin | 69.93 |
| Naphthene | 3.364 |
| Total | 100.00 |

Since the selectivities of n-hexane and n-heptane in the C6 and C7 mixture were high, n-paraffin may be effectively and selectively separated when applying a simulated moving bed (SMB), and may have higher operation economy. The characteristic of having a higher n-paraffin selectivity is a characteristic which may be observed also identically in C8, C9, and C10, and the selectivities of C8, C9, and C10 n-paraffins were 43.81 wt %, 54.78 wt %, and 59.87 wt %, which were very high, and thus, economic feasibility improvement is possible when applying an SMB process.

The compositions of C8, C9, and C10 oils which were hydrogenated after reducing pyrolysis oil naphtha-derived impurities are shown in the following Tables 24, 25, and 26, respectively:

TABLE 24

| Component | Content, wt % | Component | Content, wt % |
|---|---|---|---|
| Methylcyclopentane | | n-Octane | 43.81 |
| n-Heptane | 0.03 | c1,4-Dimethylcyclohexane | 2.53 |
| Methylcyclohexane | 0.60 | 2,4-Dimethylheptane | 12.86 |
| 2,2-Dimethylhexane | 0.48 | 4,4-dimethylheptane | 5.01 |
| Ethylcyclopentane | 0.22 | Ethylcyclohexane | 6.39 |
| 2,4-Dimethylhexane | 0.50 | 2,3,4-Trimethylhexane | 0.09 |
| 1,2,4-Trimethylcyclopentane | 0.42 | 1,2,3-Trimethylcyclopentane | 0.02 |
| 2-Methylheptane | 0.01 | 1,2-Dimethylcyclohexane | 3.25 |
| 4-Methylheptane | 2.96 | 4-Ethylheptane | 0.26 |
| 3-Methylheptane | 6.21 | 3-Ethylheptane | 0.12 |
| 1.4-Dimethylcyclohexane | 2.04 | 4-Methyloctane | 0.16 |
| 2,2,5-Trimethylhexane | 1.59 | 2-Methyloctane | 0.13 |
| i-Propylcyclopentane | 3.81 | 1-Ethyl-2-methylcyclopentane | 3.99 |
| t1,2-Dimethylcyclohexane | 0.18 | i-Butylcyclopentane | 0.03 |
| 1,2,3-Trimethylcyclopentane | 2.07 | 1,2-Diethylcyclopentane | 0.03 |
| | | 1,3-Diethylcyclopentane | 0.01 |
| | | n-Nonane | 0.04 |

TABLE 25

| Component | Content, wt % | Component | Content, wt % |
|---|---|---|---|
| n-Octane | 0.07 | n-Nonane | 54.78 |
| c1,4-Dimethylcyclohexane | 0.00 | 1-Ethyl-2-methylcyclohexane, trans | 2.61 |
| 2,4-Dimethylheptane | 4.77 | Propylcyclohexane | 7.74 |
| 4,4-dimethylheptane | 6.11 | Butylcyclopentane | 1.75 |
| Ethylcyclohexane | 0.49 | 2,5-Dimethyloctane | 0.29 |
| 2,3,4-Trimethylhexane | 0.30 | 3,3-Dimethyloctane | 0.07 |
| 1,2,3-Trimethylcyclopentane | 0.38 | 4-Ethyloctane | 0.21 |
| 1,2-Dimethylcyclohexane | 0.07 | 5-Methylnonane | 0.07 |
| 4-Ethylheptane | 1.80 | 4-Methylnonane | 0.07 |
| 3-Ethylheptane | 1.75 | 3,5-Dimethyloctane | 0.72 |
| 4-Methyloctane | 1.87 | 3-Ethyloctane | 0.05 |
| 2-Methyloctane | 2.34 | 3-Methylnonane | 0.06 |
| 1-Ethyl-2-methylcyclopentane | 0.00 | i-Butylcyclohexane | 0.01 |
| i-Butylcyclopentane | 4.05 | sec-butylcyclohexane | 0.00 |
| 1,2-Diethylcyclopentane | 4.78 | 1-Methyl-2-Propylcyclohexane | 0.00 |
| 1,3-Diethylcyclopentane | 2.77 | n-Decane | 0.02 |

TABLE 26

| Component | Content, wt % | Component | Content, wt % |
|---|---|---|---|
| n-Nonane | 0.15 | i-Butylcyclohexane | 3.19 |
| 1-Ethyl-2-methylcyclohexane, trans | 0.06 | sec-butylcyclohexane | 4.86 |
| Propylcyclohexane | 1.21 | 1-Methyl-2-Propylcyclohexane | 1.62 |
| Butylcyclopentane | 0.48 | n-Decane | 59.87 |
| 2,5-Dimethyloctane | 0.50 | 1,2-Diethylcyclohexane | 0.97 |
| 3,3-Dimethyloctane | 0.37 | 4-Methyldecane | 1.30 |
| 4-Ethyloctane | 3.09 | 2,6-Dimethylnonane | 0.97 |
| 5-Methylnonane | 1.53 | 1-Methyl-2-Propylcyclohexane | 1.78 |
| 4-Methylnonane | 2.17 | 1,4-Diethylcyclohexane | 4.86 |
| 3,5-Dimethyloctane | 1.58 | Butylcyclohexane | 1.13 |
| 3-Ethyloctane | 1.11 | Pentylcyclopentane | 0.65 |
| 3-Methylnonane | 5.27 | n-Undecane | 1.30 |

The C8, C9, and C10 mixed solvent of the following compositions also had very high naphthene contents, as with the C6 and C7 mixed solvent described above, and thus, may be advantageous for application to a paint, an adhesive, and the like in which a solvent requiring high solubility properties is used.

The following Table 27 shows a solvent composition prepared by the pyrolysis oil-derived C8 mixture, and the following Table 28 shows a solvent composition of a common petroleum-based C8 mixture.

TABLE 27

| Component | Content, wt % | Component | Content, wt % |
|---|---|---|---|
| Methylcyclopentane | 0.28 | n-Octane | 0.88 |
| n-Heptane | 0.06 | c1,4-Dimethylcyclohexane | 4.47 |
| Methylcyclohexane | 1.07 | 2,4-Dimethylheptane | 22.68 |
| 2,2-Dimethylhexane | 0.85 | 4,4-dimethylheptane | 8.84 |
| Ethylcyclopentane | 0.38 | Ethylcyclohexane | 11.28 |
| 2,4-Dimethylhexane | 0.88 | 2,3,4-Trimethylhexane | 0.16 |
| 1,2,4-Trimethylcyclopentane | 0.74 | 1,2,3-Trimethylcyclopentane | 0.04 |
| 2-Methylheptane | 0.01 | 1,2-Dimethylcyclohexane | 5.73 |
| 4-Methylheptane | 5.21 | 4-Ethylheptane | 0.45 |
| 3-Methylheptane | 10.95 | 3-Ethylheptane | 0.21 |
| 1.4-Dimethylcyclohexane | 3.61 | 4-Methyloctane | 0.28 |
| 2,2,5-Trimethylhexane | 2.80 | 2-Methyloctane | 0.22 |
| i-Propylcyclopentane | 6.72 | 1-Ethyl-2-methylcyclopentane | 7.04 |
| t1,2-Dimethylcyclohexane | 0.32 | i-Butylcyclopentane | 0.06 |
| 1,2,3-Trimethylcyclopentane | 3.66 | 1,2-Diethylcyclopentane | 0.05 |
| | | 1,3-Diethylcyclopentane | 0.02 |
| | | n-Nonane | 0.06 |
| n-paraffin | 1.00 | | |
| iso-Paraffin | 53.54 | | |
| Naphthene | 45.47 | | |

TABLE 28

| Component | Content, wt % |
|---|---|
| C7 iso-Paraffin | 0.8 |
| C8 iso-Paraffin | 99.2 |
| C9 iso-Paraffin | <0.1 |

The following Table 29 shows a solvent composition prepared by the pyrolysis oil-derived C9 mixture, and the following Table 30 shows a solvent composition of a common petroleum-based C9 mixture.

TABLE 29

| Component | Content, wt % | Component | Content, wt % |
|---|---|---|---|
| n-Octane | 0.15 | n-Nonane | 1.09 |
| c1,4-Dimethylcyclohexane | 0.00 | 1-Ethyl-2-methylcyclohexane, trans | 5.71 |
| 2,4-Dimethylheptane | 10.43 | Propylcyclohexane | 16.93 |
| 4,4-dimethylheptane | 13.38 | Butylcyclopentane | 3.84 |
| Ethylcyclohexane | 1.07 | 2,5-Dimethyloctane | 0.63 |
| 2,3,4-Trimethylhexane | 0.65 | 3,3-Dimethyloctane | 0.16 |
| 1,2,3-Trimethylcyclopentane | 0.83 | 4-Ethyloctane | 0.45 |
| 1,2-Dimethylcyclohexane | 0.14 | 5-Methylnonane | 0.14 |
| 4-Ethylheptane | 3.95 | 4-Methylnonane | 0.15 |
| 3-Ethylheptane | 3.82 | 3,5-Dimethyloctane | 1.58 |
| 4-Methyloctane | 4.08 | 3-Ethyloctane | 0.10 |
| 2-Methyloctane | 5.13 | 3-Methylnonane | 0.14 |
| 1-Ethyl-2-methylcyclopentane | 0.00 | i-Butylcyclohexane | 0.03 |
| i-Butylcyclopentane | 8.86 | sec-butylcyclohexane | 0.00 |
| 1,2-Diethylcyclopentane | 10.45 | 1-Methyl-2-Propylcyclohexane | 0.00 |
| 1,3-Diethylcyclopentane | 6.06 | n-Decane | 0.03 |
| n-Paraffin | 1.28 | | |
| iso-Paraffin | 44.79 | | |
| Naphthene | 53.93 | | |

TABLE 30

| Component | Content, wt % |
|---|---|
| C7 iso-Paraffin | <0.1 |
| C8 iso-Paraffin | 54.8 |
| C9 iso-Paraffin | 40.8 |
| C10 iso-Paraffin | 4.3 |
| C11 iso-Paraffin | <0.1 |

The following Table 31 shows a solvent composition prepared by a pyrolysis oil-derived C10 mixture, and the following Table 32 shows a solvent composition of a common petroleum-based C10 mixture.

TABLE 31

| Component | Content, wt % | Component | Content, wt % |
|---|---|---|---|
| n-Nonane | 0.38 | i-Butylcyclohexane | 7.85 |
| 1-Ethyl-2-methylcyclohexane, trans | 0.15 | sec-butylcyclohexane | 11.96 |
| Propylcyclohexane | 2.97 | 1-Methyl-2-Propylcyclohexane | 3.99 |
| Butylcyclopentane | 1.18 | n-Decane | 1.23 |
| 2,5-Dimethyloctane | 1.23 | 1,2-Diethylcyclohexane | 2.39 |
| 3,3-Dimethyloctane | 0.91 | 4-Methyldecane | 3.19 |
| 4-Ethyloctane | 7.60 | 2,6-Dimethylnonane | 2.39 |
| 5-Methylnonane | 3.76 | 1-Methyl-2-Propylcyclohexane | 4.38 |
| 4-Methylnonane | 5.33 | 1,4-Diethylcyclohexane | 11.96 |
| 3,5-Dimethyloctane | 3.88 | Butylcyclohexane | 2.79 |
| 3-Ethyloctane | 2.73 | Pentylcyclopentane | 1.59 |
| 3-Methylnonane | 12.96 | n-Undecane | 3.19 |
| n-Paraffin | 4.80 | | |
| iso-Paraffin | 43.98 | | |
| Naphthene | 51.21 | | |

TABLE 32

| Component | Content, wt % |
|---|---|
| C8 iso-Paraffin | <0.1 |
| C9 iso-Paraffin | 28.5 |
| C10 iso-Paraffin | 51.4 |
| C11 iso-Paraffin | 20.1 |

Example 2-6. Cl Reduction in Kero/LGO Oil by Solid Acid Material 99.9 kg of the Kero/LGO oil recovered in Example 1 and 30 kg of RFCC E-cat. were introduced to a 200 L autoclave, $N_2$ purging was carried out three times, and it was confirmed that there was no leak in equipment by a leak test at 30 bar of $N_2$. Then, the $N_2$ was vented, the equipment was operated at 500 rpm under the condition of 1 bar of $N_2$, and the reaction temperature was raised to 180° C. Thereafter, the temperature was maintained at 180° C. for 6 hours, the reaction was finished, stirring was performed, and the temperature was lowered to room temperature. Thereafter, venting was performed at room temperature, the autoclave was released to recover a reactant and a waste catalyst, and filtration was performed to recover treated Kero/LGO. The reaction was repeated until a Cl content was 2 wppm or less. Important changes in the physical properties related to the solvent product before and after the reaction are shown in the following Table 33:

TABLE 33

| | Cl (ppm) | N (ppm) | S (ppm) | O (wt %) |
|---|---|---|---|---|
| Kero/LGO_before reaction | 62 | 444 | 39 | 0.4 |
| Kero/LGO_after reaction | 3 | 1.4 | 15.9 | — |

Example 2-7. Separation and Hydrogenation of Kero/LGO Oil Having Reduced Impurities The Cl-reduced Kero/LGO oil recovered in Example 2-6 was subjected to a fixed layer continuous hydrogenation reaction. As the catalyst, $Ni/Al_2O_3$ which was the same catalyst of Example 2-3 was selected, 150 cc of the catalyst was loaded in the fixed bed continuous reactor, and then the catalyst was activated by the following procedure. The temperature was raised to 120° C. at a rate of 2° C./min under the conditions of 300 sccm of $N_2$ normal pressure and then maintained for 2 hours to remove the impurities on the surface of the catalyst. Thereafter, the temperature was raised to 280° C. at the same heating rate under the conditions of 40 sccm of $H_2$ normal pressure, and the treatment was performed for 8 hours to perform reduction activation of the catalyst. Thereafter, the conditions were changed to a hydrogenation reaction conditions of a temperature of 150° C., 736 sccm of $H_2$, 130 bar, and WHSV 0.5 $h^{-1}$. As a result of SimDist analysis before and after hydrogenation, it was confirmed that there was no change before and after hydrogenation as shown in FIG. 6 and Table 34.

TABLE 34

| | bp (° C.) | Kero/LGO before hydrogenation | Kero/LGO after hydrogenation |
|---|---|---|---|
| Naphtha | <150 | 0.7 | 1.8 |
| Kero/LGO | 150-265 | 38.6 | 38.4 |
| LGO | 265-340 | 43.4 | 42.9 |
| VGO | >340 | 17.3 | 16.9 |
| Total | | 100 | 100 |

Impurity analysis results are shown in following Table 35. It was confirmed that 1.39 wt % of the aromatic compound, 1 ppm or less of Cl, 0.23 ppm of N, and 0.22 ppm of S were included, and thus, the content of impurities was very low. Since Na, Al, Fe, and Ca were present at 7.5, 9.7, 0.3, and 50.9 ppb, it was confirmed that the oil had no problem for use as a solvent product.

TABLE 35

| | Content | Analysis equipment |
|---|---|---|
| Aromatic compound | 1.39 wt % | 2D-GC-FID |
| Chlorine | <1 mg/kg | IC |
| Nitrogen | 0.23 mg/kg | TNS |
| Sulfur | 0.22 mg/kg | TNS |
| Na | 7.5 ug/kg | ICP |
| Al | 9.7 ug/kg | ICP |
| Ca | 50.9 ug/kg | ICP |
| Fe | 0.3 ug/kg | ICP |

The oil hydrogenated to meet the product specifications was separated by the following boiling points, and mixed at the following mixing ratio. The mixing ratios are shown in the following Table 36.

TABLE 36

| | Recovered quantity, kg | Kero/LGO Sample A boiling point corresponding wt % | Kero/LGO Sample B boiling point corresponding wt % |
|---|---|---|---|
| IBP~135 Cut | 8.753 | | |
| 135~155 Cut | 4.471 | | |
| 155~180 Cut | 6.201 | 7.7 | 0.0 |
| 180~205 Cut | 8.865 | 38.7 | 0.0 |
| 205~230 Cut | 6.663 | 42.8 | 0.0 |
| 230~260 Cut | 9.012 | 9.0 | 2.2 |
| 260~280 Cut | 6.725 | 0.9 | 20.7 |
| 280~305 Cut | 6.786 | 0.5 | 46.5 |
| 305~330 Cut | 4.141 | 0.4 | 30.6 |
| 330~360 Cut | 0 | | |
| Total | 61.617 | 100.0 | 100.0 |

Example 2-8. Review of Applicability of Hydrogenated Kero/LGO Oil as Solvent

In order to confirm the applicability of the oils of the hydrogenated Kero/LGO samples A and B recovered in Example 2-7 as a solvent product, analysis of composition and physical properties was performed. The SimDist pattern of the prepared samples A and B is as shown in the following Table 37.

TABLE 37

| | | Sample A | Sample B |
|---|---|---|---|
| Distillation, ° C. | IBP | 194.1 | 272.8 |
| | 5% | 198.9 | 280.6 |
| | 10% | 199.3 | 281.4 |
| | 15% | 199.7 | 281.9 |
| | 20% | 200.2 | 282.2 |
| | 30% | 200.9 | 282.8 |
| | 40% | 201.8 | 283.7 |
| | 50% | 202.8 | 284.7 |
| | 60% | 204 | 285.7 |
| | 70% | 205.6 | 287.1 |
| | 80% | 207.9 | 289 |
| | 85% | 209.4 | 290.4 |
| | 90% | 211.6 | 292.2 |
| | 95% | 215.4 | 295.3 |
| | FBP | 225.3 | 301.7 |
| | Res | 1.1 | 1.3 |
| | Tot. Rec | 98.9 | 99.8 |

The results of analyzing the physical properties for confirming the applicability of sample A as a solvent are shown in FIG. 7 and Table 38. As a result of analyzing the physical properties of the sample, it was confirmed that the sample had no impurity, had a mild odor characteristic, had a high flash point, and thus, may be stably used.

TABLE 38

| Characteristics | Typical Value | Test Method |
|---|---|---|
| Color, Saybolt | +30 | ASTM D 156 |
| Specific Gravity, 15.56/15.56° C. | 0.768 | ASTM D 4052 |
| Distillation, ° C. | | ASTM D 86 |
| Initial Boiling Point | 195 | |
| 50% | 204 | |
| End point | 228 | |
| Flash Point, ° C. | 70.5 | ASTM D 56 |
| Aniline Point, ° C. | 79 | ASTM D 611 |
| Bromine Index, mg/100 g | 0.8 | ASTM D |
| Viscosity, 40° C. cSt | 1.38 | ASTM D445 |

TABLE 38-continued

| Characteristics | Typical Value | Test Method |
|---|---|---|
| Sulfur Content, wppm | <1 | ASTM D 3961 |
| Nitrogen Content, wppm | <1 | device analysis |
| Chloride Content, wppm | <1 | device analysis |
| Aromatic compound Content, vol. % | 0 | UV |

It was confirmed that sample B also had a high paraffin content and may be applied as a non-aromatic solvent, as with sample A. The results of analyzing the composition and the solvent physical properties of sample B are shown in FIG. 8 and Table 39.

TABLE 39

| Characteristics | Typical Value | Test Method |
|---|---|---|
| Color, Saybolt | +30 | ASTM D 156 |
| Specific Gravity, 15.56/15.56° C. | 0.795 | ASTM D 4052 |
| Distillation, ° C. | | ASTM D 86 |
| Initial Boiling Point | 273 | |
| 50% | 285 | |
| End point | 302 | |
| Flash Point-PMCC, ° C. | 132 | ASTM D 611 |
| Aniline Point, ° C. | 94 | ASTM D 611 |
| Bromine Index, mg/100 g | 0.14 | ASTM D |
| Viscosity, 40° C. cSt | 3.3 | ASTM D445 |
| Sulfur Content, wppm | <1 | ASTM D 3961 |
| Nitrogen Content, wppm | <1 | device analysis |
| Chloride Content, wppm | <1 | device analysis |
| Aromatic compound Content, vol. % | 0 | UV |

Although the exemplary embodiments of the present invention have been described above, the present invention is not limited to the exemplary embodiments but may be made in various forms different from each other, and those skilled in the art will understand that the present invention may be implemented in other specific forms without departing from the spirit or essential feature of the present invention. Therefore, it should be understood that the exemplary embodiments described above are not restrictive, but illustrative in all aspects.

The invention claimed is:

1. A method of preparing a solvent composition from a waste oil, the method comprising the steps of:

(a) separating at least a part of a waste oil into a first oil and a second oil, wherein the first oil has a boiling point of lower than 340° C. and the second oil has a boiling point of 340° C. or higher;

(b) reacting at least a part of the first oil to remove chlorine; and (c) hydrogenating the dechlorinated first oil, wherein in (c), the dechlorinated first oil includes less than 10 ppm of chlorine and 0.1 to 40 wt % of an olefin, with respect to the total weight.

2. The method of preparing a solvent composition from a waste oil of claim 1, wherein the waste oil is at least one selected from the group consisting of a waste plastic pyrolysis oil, a biomass pyrolysis oil, a regenerated lubricating oil, a crude oil having a high chlorine content, and a mixture thereof.

3. The method of preparing a solvent composition from a waste oil of claim 1, wherein in step (b), the first oil includes 30 to 90 wt % of a normal paraffin, 0.1 to 30 wt % of an isoparaffin, 0.1 to 90 wt % of olefins, 0.1 to 20 wt % of a naphthene, and 0.1 to 20 wt % of an aromatic compound, with respect to the total weight.

4. The method of preparing a solvent composition from a waste oil of claim 1, wherein the first oil includes H-naphtha (heavy naphtha) (—C8, bp<150° C.) and Kero/LGO (C9-C20, bp 150-340° C.) at a weight ratio of 1:1 to 1:10.

5. The method of preparing a solvent composition from a waste oil of claim 1, wherein in step (b), a mixture of the first oil and a solid acid material is prepared, and the mixture is reacted to remove chlorine.

6. The method of preparing a solvent composition from a waste oil of claim 1, wherein the hydrogenation process of step (c) is performed in the presence of a hydrogenation catalyst under a hydrogen atmosphere, and the hydrogenation catalyst includes:

(i) one or more hydrogenation metal components selected from the group consisting of VIB group metals and VIII group metals and (ii) a carrier which is alumina, silica, silica-alumina, titanium oxide, molecular sieve, zirconia, aluminum phosphate, carbon, niobia, or a mixture thereof.

7. The method of preparing a solvent composition from a waste oil of claim 1, wherein the hydrogenation process of step (c) satisfies the following Relation 1:

[Relation 1]

$0.95<A/B<1.05$ wherein A and B are weight average molecular weights of dechlorinated first oils before and after hydrogenation, respectively.

8. The method of preparing a solvent composition from a waste oil of claim 1, wherein the hydrogenation process of step (c) produces 3 wt % or less of an oil vapor with respect to a total weight of the dechlorinated first oil.

9. A method of preparing a solvent composition from a waste oil, the method comprising:

(a) separating at least a part of a waste oil into a first oil and a second oil, wherein the first oil has a boiling point of lower than 340° C. and the second oil has a boiling point of 340° C. or higher;

(b) reacting at least a part of the first oil to remove chlorine; and (c) hydrogenating the dechlorinated first oil, wherein in (b), a mixture of the first oil and a solid acid material is prepared, and the mixture is reacted to remove chlorine.

* * * * *